US005362335A

United States Patent [19]

Rungta

[11] Patent Number: 5,362,335

[45] Date of Patent: Nov. 8, 1994

[54] RARE EARTH COATING PROCESS FOR ALUMINUM ALLOYS

[75] Inventor: Ravi Rungta, East Amherst, N.Y.

[73] Assignee: General Motors Corporation, Detroit, Mich.

[21] Appl. No.: 37,142

[22] Filed: Mar. 25, 1993

[51] Int. Cl.[5] ..... C23C 22/56

[52] U.S. Cl. ..... 148/272; 148/275; 148/273

[58] Field of Search ..... 148/273, 272, 275

[56] References Cited

U.S. PATENT DOCUMENTS 5,192,374 3/1993 Kindler ..... 148/273
5,194,138 3/1993 Mansfield ..... 148/273

FOREIGN PATENT DOCUMENTS

WO88/06639 7/1988 Australia ..... C23C 22/48

OTHER PUBLICATIONS

B. R. W. Hinton, "New Approaches to Corrosion Inhibition with Rare Earth Metal Salts," Corrison 89, Paper No. 170, NACE.

*Primary Examiner*—Sam Silverberg
*Attorney, Agent, or Firm*—George A. Grove

[57] ABSTRACT

A method is provided by which a corrosion-resistant barrier layer composed of a rare earth oxide coating incorporated in an oxide film is developed on the surface of a metal for the purpose of improving the corrosion resistance of the metal. The method is particularly suitable for forming a corrosion-resistant barrier on an aluminum alloy, in which the corrosion-resistant barrier layer is composed of a cerium oxide coating incorporated with a uniform aluminum oxide film which has been formed on the aluminum alloy. The corrosion-resistant barrier layer exhibits a broader passivation range as compared to chromium conversion coatings typically used in the art. Simultaneously, the method of this invention avoids the environmental hazards associated with chromium conversion processes, making the method more suitable for manufacturing operations. Furthermore, the method of this invention does not employ hazardous compounds, making the process suitable for a manufacturing environment.

8 Claims, 3 Drawing Sheets

RARE EARTH COATING PROCESS FOR ALUMINUM ALLOYS

The present invention generally relates to the formation of protective oxide coatings for aluminum alloys for the purpose of enhancing the corrosion resistance of the aluminum alloy. More particularly, this invention relates to a process by which a rare earth oxide coating is formed on an aluminum alloy using chemical methods which are generally non-polluting and non-hazardous to the environment, wherein the rare earth oxide coating, along with an aluminum oxide film present on the aluminum alloy, significantly enhances the corrosion resistance of the aluminum alloy.

BACKGROUND OF THE INVENTION

As is well known, aluminum alloys form a tenaciously adherent aluminum oxide ($Al_2O_3$) film when exposed to atmospheric air at ambient temperatures. The formation of the aluminum oxide film essentially prevents further oxidation of the aluminum alloy and thus serves as a corrosion inhibitor. When better corrosion resistance is required, aluminum alloys are often anodized, which is a chemical conversion at the surface of the aluminum alloy to form a thick and uniform aluminum oxide film. Because the anodizing process involves an applied voltage while the alloy component is in an electrolytic bath, the uniformity of the aluminum oxide film is significantly diminished if the component has a complex geometry. Though a great improvement in corrosion resistance is not necessarily attained, the resulting oxide film provides an adhesive base for organic coatings and paints.

Chromate conversion coating is another form of chemical conversion which has been traditionally employed as a corrosion protection mechanism for aluminum alloys, particularly when the alloy will be used in a highly corrosive environment, such as a heat exchanger for an automobile. The process involves exposing the aluminum alloy to chromic acid, together with an activator such as ferri-cyanide or molybdate, so as to form a chromium oxide barrier layer containing chromate ions, which serve as an inhibitor of corrosion for aluminum alloys. The barrier layer not only improves the corrosion resistance of the article on which it is formed, but also provides an adhesive base for subsequent coating processes.

However, due to the toxicity of chromium, environmental laws require that the presence of chromium in the waste stream discharged from a manufacturing facility be substantially reduced. Environmental and health concerns, coupled with the high costs associated with limiting the amount of chromium released to the environment from a chromium conversion process, have prompted the search for a suitable non-chromium, corrosion-resistant coating for aluminum alloys.

One such coating is discussed in Australian Patent No. We 88/06639, in which an aluminum alloy is exposed to an acidic mixture of hydrogen peroxide ($H_2O_2$) and cerous chloride ($CeCl_3.xH_2O$; also known as cerium chloride) to form a cerium oxide ($CeO_2$) coating on the aluminum alloy. The cerium oxide coating serves as a barrier layer whose corrosion resistance is superior to that of aluminum oxide, so as to enhance the corrosion protection of the underlying aluminum alloy. The Australian patent suggests that the coating of cerium oxide, also referred to as cerium dioxide, ceric oxide and ceria, is generated without first forming a uniform, significant aluminum oxide film on the alloy. Though the use of a cerium oxide coating provides the benefits of a corrosion-resistant coating without the toxicity of chromium, a disadvantage with the process disclosed by the Australian patent is the use of hydrogen peroxide, which is considered hazardous in a manufacturing environment because it poses a dangerous fire and explosion risk, particularly at high concentrations.

Thus, it would be desirable to provide a method for forming a suitable barrier layer on aluminum alloys for the purpose of enhancing the corrosion resistance of aluminum alloys, while avoiding the use of toxic, polluting and hazardous compounds, such as chromium and hydrogen peroxide.

SUMMARY OF THE INVENTION

It is an object of this invention to provide a method for improving the corrosion resistance of metals, such as aluminum alloys, without the use of toxic compounds such as chromium.

It is a further object of this invention that such a method involve the formation of a rare earth oxide coating on the surface of a metal, such that the rare earth oxide serves as a corrosion-resistant barrier layer on the metal surface.

It is yet another object of this invention that such a barrier layer exhibit improved corrosion protection to the underlying metal surface as compared to chromium conversion coatings and aluminum oxide and cerium oxide barrier layers formed by methods known in the prior art.

Lastly, it is still a further object of this invention that such a method be substantially non-hazardous within a manufacturing facility and non-polluting to the environment.

In accordance with a preferred embodiment of this invention, these and other objects and advantages are accomplished as follows.

According to the present invention, there is provided a method for improving the corrosion resistance of a metal by forming a corrosion-resistant barrier layer on the surface of the metal. The barrier layer is essentially a combination of a metal oxide and a rare earth oxide which together cooperate to extend the protection range of the underlying metal. The barrier layer of this invention provides corrosion protection which is superior to that for chromium conversion coatings, oxide films and rare earth oxide coatings known in the prior art, in terms of the resulting passivity range of the metal. The barrier layer is also superior to known anodizing processes in that the barrier layer is formed without the use of an applied voltage, such that the uniformity of the barrier layer is substantially independent of the geometry of the component being coated. Furthermore, the method of this invention is an improvement over the method taught by Australian Patent No. WO 88/06639, in that enhanced corrosion protection is attained without the use of a dangerous or flammable substance, such as hydrogen peroxide.

The invention is generally a two step process in which a uniform oxide film is first formed by appropriately treating the metal surface. More specifically, in the case of an aluminum alloy, a hygroscopic composition such as triethanolamine is used to form a bohmite ($Al_2O_3.H_2O$) film on the surface of the alloy. A rare earth oxide coating is then developed by treating the metal surface with an aqueous solution of a rare earth chloride at a predetermined temperature and for a predetermined duration. Incorporation of the rare earth oxide coating with the bohmite film occurs in the sense that the barrier layer is a mixture of aluminum and rare earth oxide.

The incorporation of the rare earth oxide in the aluminum oxide film of an aluminum alloy significantly extends the passivity range of the aluminum alloy, particularly when compared to either an aluminum oxide film or a rare earth oxide coating formed on the surface of the aluminum alloy. Furthermore, it has been determined that the barrier layer of this invention offers a broader passivation range for aluminum alloys than that provided by traditional chromium conversion coatings. The method of this invention is able to achieve the above advantages without the environmental concerns associated with chromium conversion processes, and without the fire and explosion hazards associated with the use of hydrogen peroxide. Accordingly, the processing steps encompassed by this invention are highly suited for modem manufacturing methods, which are continuously being confronted with more stringent pollution and safety standards.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawing wherein.

DETAILED DESCRIPTION OF THE INVENTION

Figure 1:
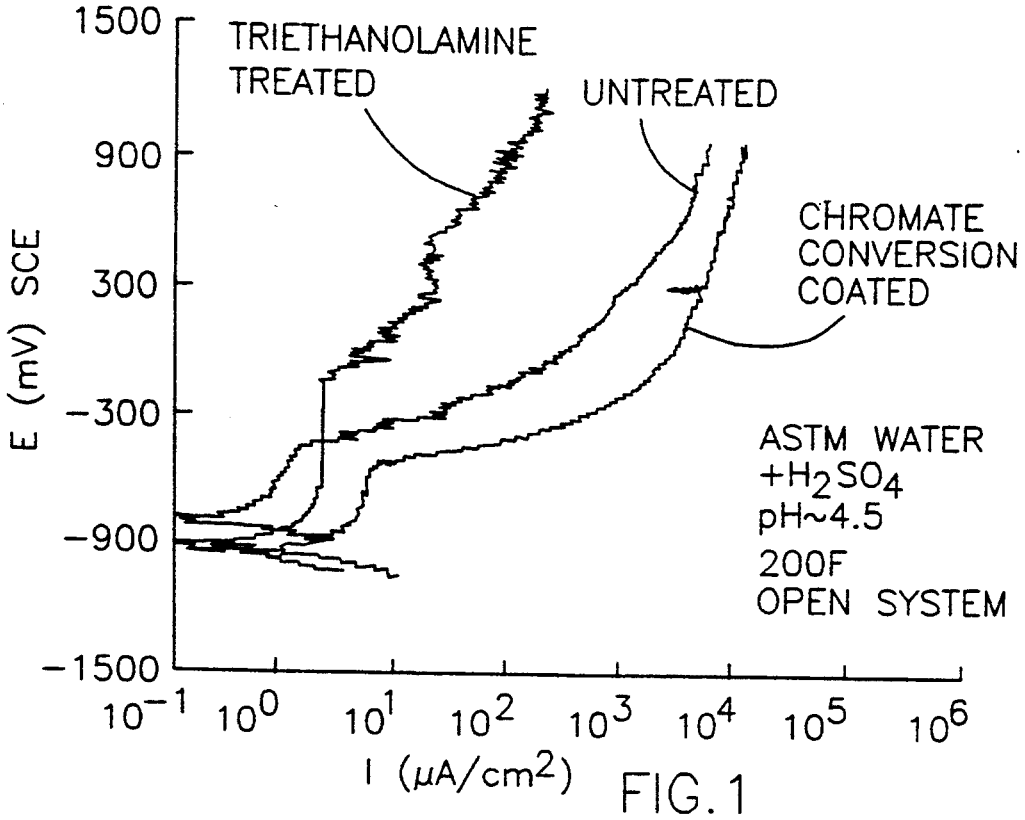
FIG. 1 is a graph which compares the passivation ranges and passivation current densities for aluminum alloy samples in an untreated condition, coated by chromium conversion, and coated with an aluminum oxide film after being treated with triethanolamine.

A method is provided by which a corrosion-resistant coating composed of a rare earth oxide coating, which is incorporated in a film of oxide formed from the base metal, is developed on the surface of that metal for the purpose of improving the corrosion resistance of the metal. The corrosion-resistant coating exhibits a broader passivation range as compared to chromium conversion coatings typically used in the art. Simultaneously, the method of this invention avoids the environmental hazards associated with chromium conversion processes, making the method more suitable for manufacturing operations. Furthermore, the method of this invention is an improvement over the process disclosed in Australian Patent No. WO 88/06639. in that the barrier layer developed in accordance with this invention provides a more consistent corrosion protection in comparison to the findings of the Australian patent. In addition, enhanced corrosion protection through the formation of a rare earth oxide coating is attained without the use of hydrogen peroxide during the coating process, making the process less hazardous than that taught by the prior art.

Primarily, the invention is directed to a method by which a rare earth oxide coating, such as a cerium oxide coating, is developed on an aluminum alloy onto which a uniform aluminum oxide film has been previously formed. The cerium oxide coating, in cooperation with the aluminum oxide film, significantly extends the corrosion protection range for the aluminum alloy. It is noted that aluminum alloys are currently of particular concern in that manufacturers are continuously finding more applications for these alloys, particularly within the automotive industry. However, the environment of an automobile is highly corrosive, necessitating that such alloys be provided with additional corrosion protection. The corrosion-resistant barrier layer of this invention is particularly suited for such applications. In addition, further corrosion protection can be readily attained by painting the barrier layer, which provides a highly adherent surface for other coating materials.

While the following discussion is directed to the coating of aluminum alloys with a cerium oxide coating, the principals taught by this invention are applicable to other metals, such as steels, and also applicable to the formation of other rare earth oxide coatings such as those formed from the oxides of lanthanum, yttrium and scandium. Such rare earth oxide coatings, when incorporated within a suitable oxide film, will extend the corrosion protection range for the particular metal used.

The preferred method of this invention includes two primary processing steps, the first of which involves forming a uniform oxide film on the surface of a suitable aluminum alloy. The second step involves developing a cerium oxide coating on the alloy, which is incorporated into the aluminum oxide film by a chemical reaction process.

To promote the formation of a uniform aluminum oxide film, it is important to remove all oils and other contaminants from the surface of the metal so as to promote the ability of the metal to develop a uniform oxide film. Numerous acidic or basic cleaning methods and agents are known to those skilled in the art for this purpose.

For purposes of the present invention, the basic cleaner PC522 was used, whose formulation is proprietary but commercially available from Circle Prosco, Inc. The preferred cleaning method involves combining this cleaner with tap water to form a solution containing 6 percent by volume of the cleaner. The solution is then heated to a temperature which is sufficient to provide a balance between extent of attack and time of immersion, generally about 135 ° F., and the aluminum alloy is treated with the cleaning solution for a duration which is sufficient to remove any oil or other contaminant from the alloy's surface. Typically, three minutes is sufficient for this purpose, though longer and shorter durations are foreseeable, depending on the particular contaminant encountered and the type of cleaner used. The alloy is then thoroughly rinsed with water to remove any residue of the cleaning solution.

The surface of the aluminum alloy is then treated with a hygroscopic solution. In the preferred embodiment, the hygroscopic solution is a 0.1 volume percent aqueous solution of triethanolamine, though solutions having a triethanolamine volume percent of about 0.1 to about 10 would also be suitable. The triethanolamine is the preferred hygroscopic compound because of its ability to produce a uniform bohmite film on the aluminum alloy. Most preferably, the triethanolamine is diluted in deionized water, and the solution is heated to a temperature which will be sufficient to promote the development of a bohmite film on the surface of the alloy. It has been found that treating an aluminum alloy with the triethanolamine solution at a temperature of about 160° F. to about 210° F., and more preferably about 180° F., for a duration of about 1 to about 8 minutes, and more preferably about 4 minutes, has developed a suitable bohmite film on the surface of the alloy. Again, the surface of the alloy is thoroughly rinsed with water to remove any residue of the triethanolamine solution.

Generally, the bohmite film developed according to the above process will be uniform, having a thickness on the order of a few micrometers. The need for a uniform aluminum oxide film is particularly important in the subsequent incorporation of the cerium oxide in the bohmite fill by the reaction of the aluminum oxide with cerous chloride.

The alloy is then treated with a suitable aqueous solution of cerous chloride. As will be disclosed more fully below, the preferred solution is composed of about 10,000 parts per million (ppm) of cerous chloride in tap water, with the solution being adjusted to a pH of about 4 and held at a temperature of about 135° F. for a treatment duration of about 15 minutes. As is conventional, the pH of the solution can be adjusted with hydrochloric acid and sodium hydroxide to attain the preferred pH level.

After a suitable coating of cerium oxide has been developed on the surface of the aluminum alloy, the alloy is again rinsed with water and dried. Generally the drying temperature can range between about 200° F. and about 320° F., with the preferred temperature being about 320° F. A suitable drying time can range between about 10 and about 30 minutes, with a preferred duration of about 10 minutes.

It is believed that this process incorporates the cerium oxide into the aluminum oxide film by an exchange reaction. The mixed barrier layer behaves like an insulator with a significantly higher breakdown potential and does not allow either oxidation or reduction reactions to occur. In aluminum alloys where pitting is the primary mode of corrosion attack, the reduced oxidation/reduction rate coupled with an extended passivation range affords a corrosion performance improvement. In accordance with this invention, this resulting barrier layer exhibits a broader passivation range than that for chromium conversion coatings, as well as that for typical aluminum oxide films.

Figure 2:
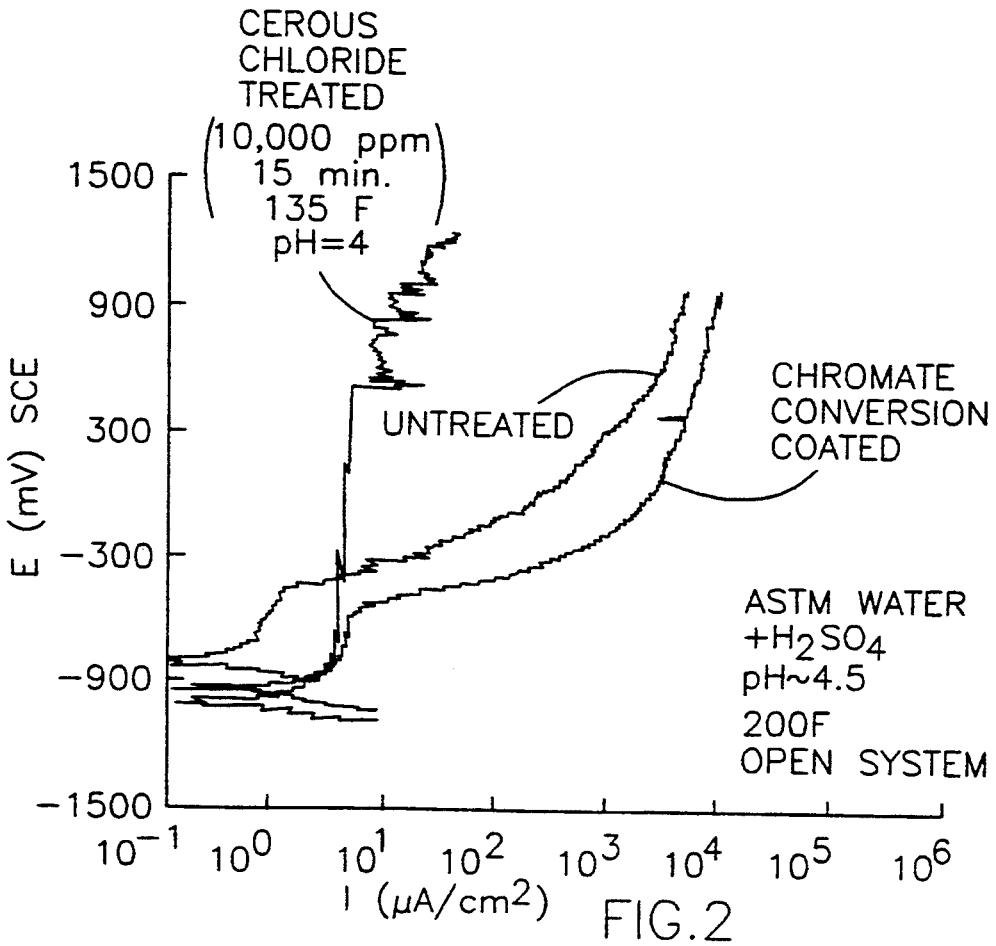
FIG. 2 is a graph which compares the passivation ranges and passivation current densities for aluminum alloy samples in an untreated condition, coated by chromium conversion, and coated with cerium oxide which has been incorporated into an aluminum oxide film in accordance with this invention.

Referring to FIGS. 1 and 2, results are graphed of an evaluation conducted on the basis of potentiodynamic measurements of aluminum alloy 3102 specimens using an ASTM Standard D 1384-87 corrosive water solution. Generally, this test serves to demonstrate the corrosion behavior of a material when exposed to a corrosive environment. The corrosive water solution contained 100 ppm each of chlorides, sulfates and bicarbonates introduced as sodium salts. The pH of the corrosive water solution was adjusted to about 4.5 with the addition of sulfuric acid. The tests were conducted in an open system (i.e., no de-aeration) at about 200° F. at a scan rate of about 0.1 mV/second. Potential was measured with reference to a saturated calomel electrode (SCE).

Generally, the x-axis of the graphs corresponds to the current density for the specimens, while the y-axis corresponds to the electrode potential applied during the evaluation. The electrode potential can be roughly equated to the oxidizing power of a corrosive medium, while the current density indicates the dissolution rate of the alloy. Accordingly, a low current density and a broad passivation range are desirable from the standpoint of corrosion resistance. The passivation range over which a given specimen is generally passive to the corrosive medium is represented by the nearly vertical portion of each curve—e.g., as tested, generally in the vicinity of current densities of about 1 to about 10 milliamps per centimeter squared.

FIG. 1 represents the results of potentiodynamic measurements taken of an untreated specimen, a specimen coated with a chromium conversion layer, and a specimen which has been treated with only an aqueous solution of triethanolamine so as to have a uniform film of aluminum oxide on its exposed surface. The graph indicates limited passivation behavior in the untreated specimen. The specimen with the chromium conversion coating also exhibited only limited passivity. The specimen treated with triethanolamine displayed a broader range of passivation. Generally, all three samples had very low but similar passivation current densities.

Referring now to FIG. 2, the corrosion behavior of a specimen treated in accordance with the teachings of this invention is compared to the untreated and chromium conversion coated specimens of FIG. 1. The specimen was treated in accordance with the preferred method of this invention, as previously described above. Specifically, the aqueous solution of cerous chloride was composed of about 10,000 ppm of cerous chloride in tap water, with the solution being adjusted to a pH of about 4 and held at a temperature of about 135° F. The specimen was then treated with the cerous chloride solution for a duration of about 15 minutes to form the cerium oxide coating. The cerium oxide coating was then incorporated with the aluminum oxide film which was formed as a result of treating the specimen with the preferred triethanolamine solution of this invention.

As can be readily seen from the graph, the incorporation of a cerium oxide coating with an aluminum oxide film resulted in a significantly broader passivation range, though the passivation current density remained roughly within the same range as the other two samples. Accordingly, the advantage of the barrier layer formed in accordance with the teachings of this invention is to primarily extend the passivation range of the alloy. In practice, the result of this greater passivation range is to make an alloy resistant to corrosive mediums with a broader range of oxidizing strengths—i.e., environments which are more corrosively aggressive.

The preferred ranges for the treatment duration, solution temperature, solution concentration and solution pH can vary from the preferred values indicated above. Results of tests which suggest general ranges for the above parameters are illustrated in FIGS. 3 through 6. Except as indicated, each of the tests was conducted with the preferred aqueous solution of cerous chloride and within the same corrosive water solution described for FIGS. 1 and 2.

Figure 3:
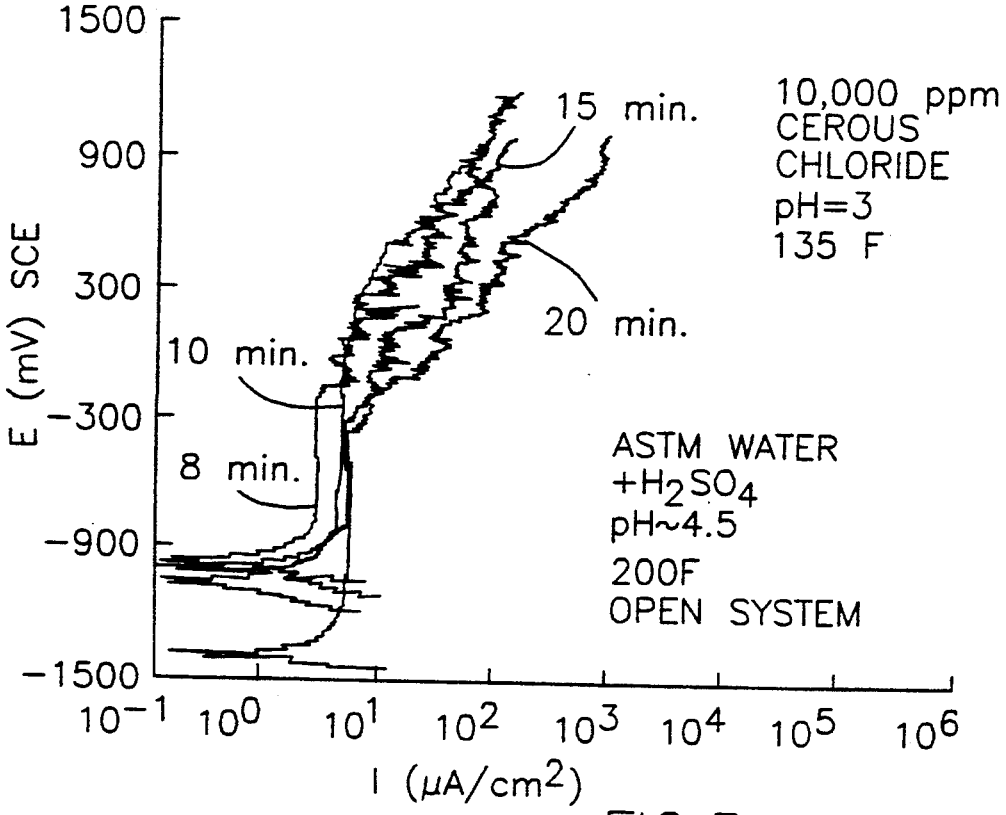
FIG. 3 is a graph which illustrates the effect that the duration of a cerous chloride treatment has on the passivation range and passivation current density for an aluminum alloy when performed in accordance with this invention.

FIG. 3 compares the effect that the duration of the cerous chloride treatment has on the passivation range and passivation current density of a 3102 aluminum alloy. For purposes of this evaluation, the cerous chloride solution was adjusted to a pH of about 3. The results indicated that, with a pH of about 3, the preferred duration for this treatment is between about 8 and 20 minutes, with a duration of about 10 minutes appearing to be optimal. Tremendous variability in the data was obtained for a duration of 8 minutes, while a duration of about 20 minutes appeared to be too long on the basis of a reduced passivation range. Accordingly, a preferred range appears to likely be about 10 to about 15 minutes for a solution pH of about 3. For a solution pH of about 4, it was projected that a duration of about 15 minutes would be optimum (on the basis of the results seen in FIG. 2). Generally, a range of about 10 to about 20 minutes is recommended depending upon the pH and temperature of the solution.

Figure 4:
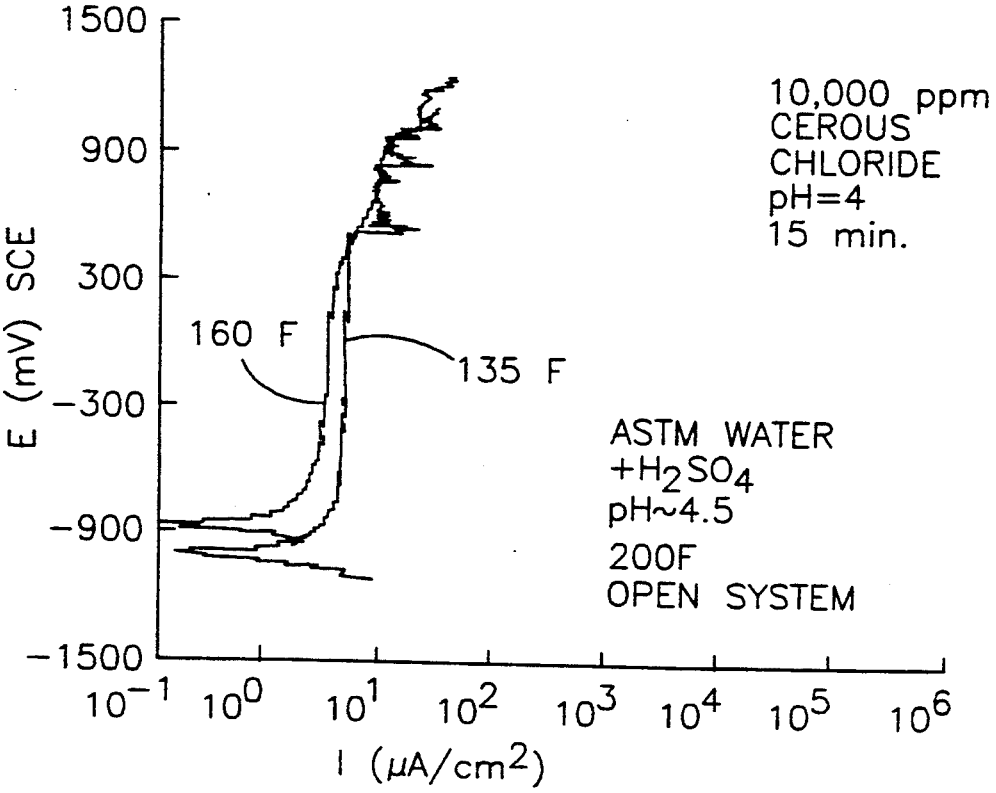
FIG. 4 is a graph which illustrates the effect that the temperature of the cerous chloride solution has on the passivation range and passivation current density for an aluminum alloy coated in accordance with this invention.

FIG. 4 compares the influence that the temperature of the cerous chloride solution has on the quality of the barrier layer developed in accordance with this invention. The temperatures for the test were chosen on the basis of a balance between temperature and treatment time—e.g., a lower temperature would require a longer treatment time. The difference between the 160° F. curve and the 135° F. curve was marginal. At 160° F., the passivation current density was lower, but so was the passivation range. Accordingly, these results suggest that a fairly wide temperature range of about 100° F. to about 200° F. would be satisfactory, which is advantageous for the commercial coating operations for which this invention is intended. However, based on a broader passivation range being exhibited, it is preferable that the temperature of the cerous chloride solution be controlled closer to about 135° F.

Figure 5:
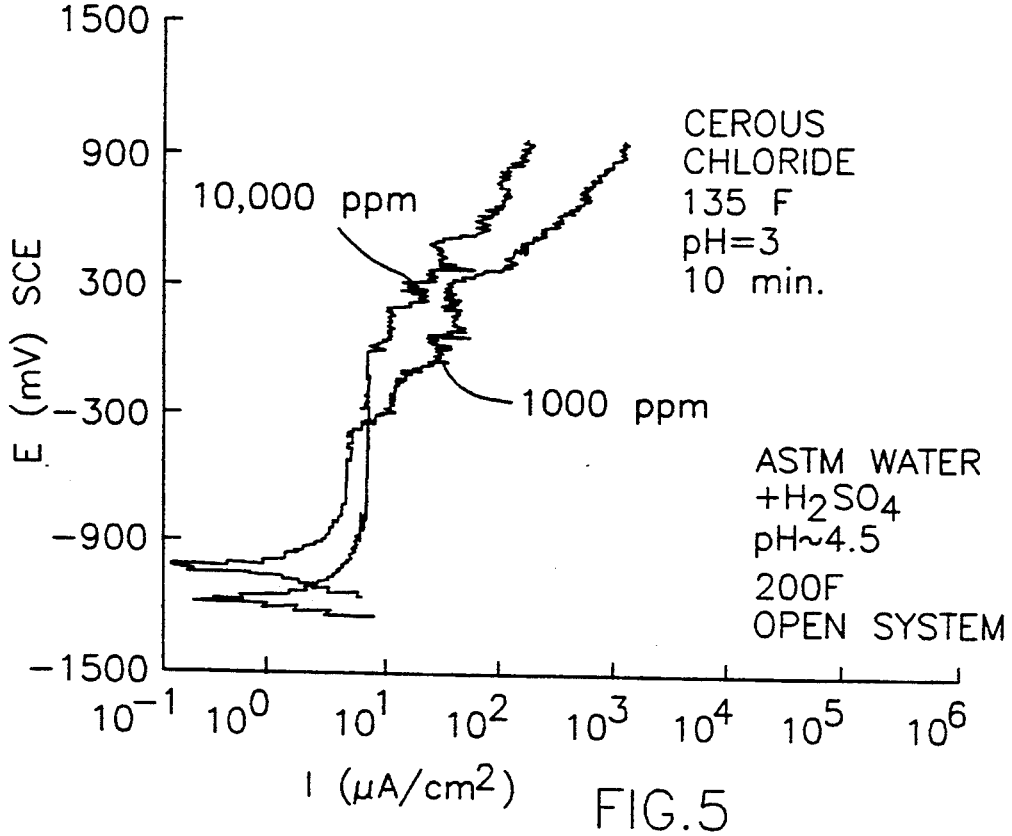
FIG. 5 is a graph which illustrates the effect that the concentration of the cerous chloride solution has on the passivation range and passivation current density for an aluminum alloy coated in accordance with this invention.

FIG. 5 compares the influence which the concentration of the cerous chloride solution has on the coating quality of 3102 aluminum alloy specimens. Two solutions were formulated, each with a solution pH of about 3. The first solution had a cerous chloride concentration of about 10,000 ppm, while the second solution had a cerous chloride concentration of about 1000 ppm. The duration of the treatment for each was about 10 minutes. From the results, it can be seen that the higher concentration level resulted in a lower passivation current density, but exhibited a significantly broader passivation range. Accordingly, under these conditions, a solution concentration of about 10,000 ppm would be preferred. Based on these results, it is projected that a range of about 8000 to about 12,000 ppm would be suitable for solutions with a pH of up to about 4 and for treatment durations of about 10 to about 20 minutes.

Figure 6:
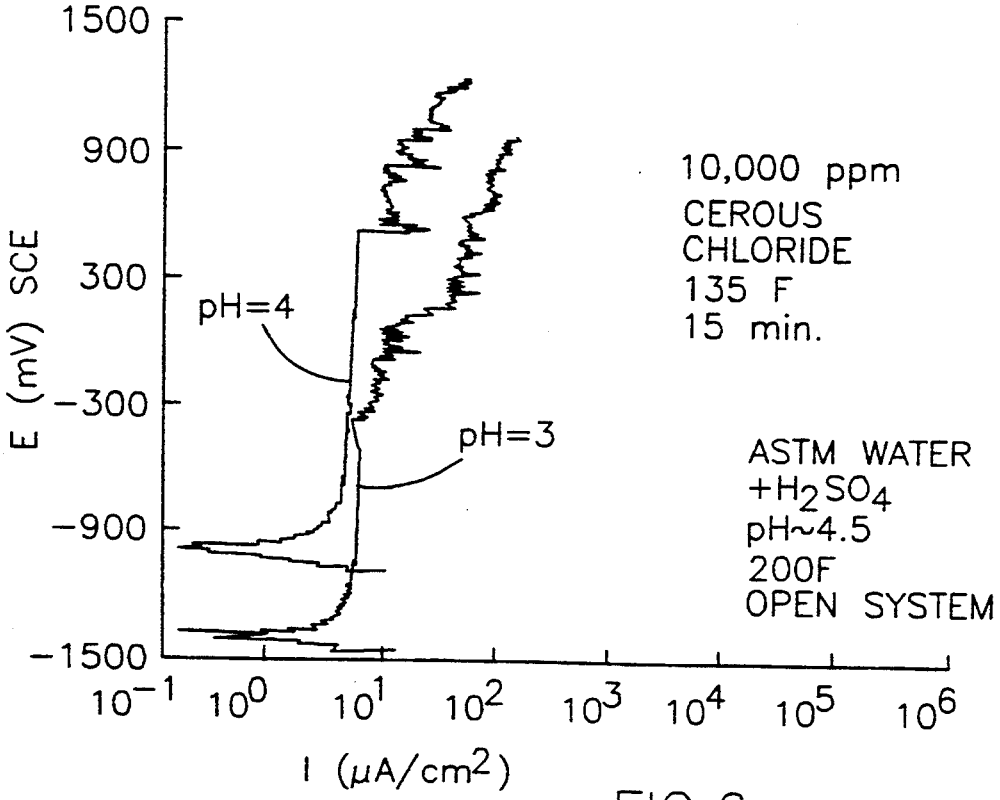
FIG. 6 is a graph which illustrates the effect that the pH of the cerous chloride solution has on the passivation range and passivation current density for an aluminum alloy coated in accordance with this invention.

FIGS. 6 illustrates the influence that the solution pH has on the quality of the barrier layer developed by the method of this invention. As can be seen from the graph, solution pH is a strong factor in the quality of the barrier layer developed, with a pH of about 4 being significantly superior to a pH of about 3. It is projected that a pH range of about 3 to about 5 would yield a suitable barrier layer.

From the above, it is apparent that the treatment duration, solution concentration, solution temperature, and solution pH each contribute to the quality of the barrier layer formed in accordance with the method of this invention. Accordingly, these parameters are to be balanced in order to develop a suitable barrier layer. From the above results, a solution concentration of about 8000 to about 12,000 ppm, a pH of about 4, and a treatment duration of about 15 minutes was identified as being preferred for the process and the cerous chloride solution used in the process of the present invention. However, in view of the interdependency of the process parameters, it is entirely foreseeable that suitable results could also be obtained for concentrations, pH levels and durations other than those indicated above as being preferred. Generally, such foreseeable process parameters would include using a pH range of about 3 to about 5, treatment durations of about 10 to about 20 minutes, and solution temperatures of about 100° F. to about 200° F.

It should also be noted that while the preferred embodiment encompasses a 3102 aluminum alloy, the teachings of this invention are also applicable to other aluminum alloys. In fact, with little or no modifications to the preferred process parameters, it is expected that the barrier layer developed by this invention would significantly extend the corrosion protection range for all aluminum alloys.

Furthermore, it is also anticipated that this process is applicable to other metals, in that it is the incorporation of the cerium oxide coating in an underlying oxide film which appears to provide the corrosion resistance indicated by the above test results. In that virtually all metals form an oxide, it is foreseeable that the teachings of this invention can be readily extended to other alloys, such as steels.

Finally, it is also anticipated that this process is applicable to the use of other rare earth oxides for the purpose of forming a corrosion-resistant barrier layer on a metal. In particular, oxides of lanthanum, yttrium and scandium would also be expected to behave and perform in much the same manner as cerium oxide in the disclosed examples. Similar to the preferred embodiment described above, these oxides coatings would be formed by treating the metal surface with an aqueous solution of the corresponding rare earth chloride.

From the above, it can be seen that the incorporation of a layer of cerium oxide in a base metal oxide film significantly extends the passivity range of the metal in comparison to the metal oxide alone. Furthermore, the barrier layer of this invention offers corrosion protection which is superior to that provided by chromium conversion coatings known in the prior art. The preferred barrier layer can be formed in accordance with the method of this invention to achieve the above advantages without the known disadvantages of the prior art—namely, the environmental concerns associated with chromium conversion processes and the fire and explosion hazards associated with the use of hydrogen peroxide. Accordingly, the method taught by this invention is highly suited for use within a manufacturing environment.

While our invention has been described in terms of a preferred embodiment, it is apparent that other forms could be adopted by one skilled in the art; for example, by modifying the processing parameters such as the temperatures, concentrations, pH levels or durations employed, or by substituting appropriate metallic alloys for the aluminum alloy used in the examples. Accordingly, the scope of our invention is to be limited only by the following claims.

The embodiments of the invention in which an exclusive property or privilege is claimed are defined as follows:

1. A process for enhancing the corrosion resistance of an aluminum alloy, the process comprising the steps of:

exposing a surface of the aluminum alloy to a hygroscopic solution so as to form a bohmite film on the aluminum alloy;

exposing the aluminum alloy to an aqueous solution consisting essentially of cerous chloride and water at a temperature of about 100° F. to about 200° F. and for a duration of about 10 to about 20 minutes so as to form cerium oxide on the aluminum alloy, such that the cerium oxide is incorporated in the bohmite film, the aqueous solution of cerous chloride comprising about 8000 to about 12,000 ppm cerous chloride and having a pH of about 3 to about 5;

rinsing the aluminum alloy in water; and drying the aluminum alloy at an elevated temperature of about 200° F. to about 320° F. and for a duration of about 10 to about 30 minutes, so as to form a mixed barrier layer of the cerium oxide in the bohmite film which significantly extends the passivity range of the aluminum alloy.

2. A process as recited in claim 1 wherein the hygroscopic solution is an aqueous solution of triethanolamine.

3. A process as recited in claim 2 wherein the aqueous solution of triethanolamine comprises about 0.1 to 10 volume percent triethanolamine in water.

4. A process as recited in claim 1 wherein the temperature of the hygroscopic solution is about 160° F. to about 210° F.

5. A process as recited in claim 1 wherein the aluminum alloy is exposed to the hygroscopic solution for a duration of about 1 to about 8 minutes.

6. A process as recited in claim 1 further comprising the step of cleaning the surface of the aluminum alloy prior to the step of exposing the surface of the aluminum alloy to the hygroscopic solution so as to facilitate the formation of the aluminum oxide film.

7. A process as recited in claim 1 further comprising the step of painting the surface of the aluminum alloy after drying the aluminum alloy.

8. A process for enhancing the corrosion resistance of an aluminum alloy, the process comprising the steps of:

cleaning a surface of the aluminum alloy;

exposing a surface of the aluminum alloy to triethanolamine in deionized water at a temperature of about 160° F. to about 210° F. and for a duration of about 1 to about 8 minutes so as to form a bohmite film on the aluminum alloy;

rinsing the aluminum alloy with water;

exposing the aluminum alloy to an aqueous solution consisting essentially of cerous chloride and water at a temperature of about 100° F. to about 200° F. and for a duration of about 10 to about 20 minutes so as to form cerium oxide on the aluminum alloy, the aqueous solution of cerous chloride comprising about 8000 to about 12,000 ppm cerous chloride and having a pH of about 3 to about 5;

rinsing the aluminum alloy in water; and drying the aluminum alloy at a temperature of about 200° F. to about 320° F. and for a duration of about 10 to about 30 minutes;

whereby the incorporation of the cerium oxide in the bohmite film significantly extends the passivity range of the aluminum alloy.

* * * * *